United States Patent [19]

Chierici

[11] 4,344,541

[45] Aug. 17, 1982

[54] COUPLER CARRIER ARRANGEMENT FOR RAILROAD CARS

[75] Inventor: Osvaldo F. Chierici, Elmhurst, Ill.

[73] Assignee: Holland Company, Aurora, Ill.

[21] Appl. No.: 175,318

[22] Filed: Aug. 4, 1980

Related U.S. Application Data

[63] Continuation of Ser. No. 20,438, Mar. 14, 1979, abandoned, which is a continuation of Ser. No. 828,237, Aug. 26, 1977, abandoned.

[51] Int. Cl.[3] ..... B61G 7/10

[52] U.S. Cl. ..... 213/61; 213/21; 213/51; 308/DIG. 8

[58] Field of Search ..... 213/61, 62, 20, 21, 213/60, 58, 59, 51–53, 56, 40; 308/DIG. 8, DIG. 9, 244, 240, 3 R, 5 R, 238, 163–168

[56] References Cited

U.S. PATENT DOCUMENTS

| | | | |
|---|---|---|---|
| 2,718,968 | 9/1955 | Metzger | 213/61 |
| 3,240,354 | 3/1966 | Williams | 213/61 X |
| 4,006,051 | 2/1977 | Board, Jr. | 308/238 X |
| 4,055,254 | 10/1977 | Chierici et al. | 213/21 X |

FOREIGN PATENT DOCUMENTS

| | | | |
|---|---|---|---|
| 1283534 | 2/1969 | Fed. Rep. of Germany | 303/DIG. 8 |

OTHER PUBLICATIONS

1974 Edition of Car and Locomotive Cyclopedia published by Simmons-Boardman Publishing Company, pp. 58–19.

*Primary Examiner*—Douglas C. Butler
*Attorney, Agent, or Firm*—McWilliams, Mann & Zummer

[57] ABSTRACT

A coupler carrier arrangement for railroad cars, in which the car center sill ends are equipped with a striker casting through which the car coupler shank extends for connection to the car center sill, with the striker casting having the familiar cage, in which the coupler carrier is mounted, including an upwardly opening socket on the underside of the casting defining a coupler carrier chamber, in which the coupler carrier itself comprises a body formed from an ultra high molecular weight polymer of dry self lubricating characteristics that replaces both the conventional coupler carrier and the carrier iron, and is shaped to define a horizontally disposed upwardly facing load support surface on which the coupler shank rests, and oppositely facing forward and rearward side walls defining vertically disposed slide surfaces formed for close fitting relation to the coupler carrier chamber inner and outer walls. The coupler carrier load support and side slide surfaces are of integral one piece construction, and are characterized by effecting resurfacing of the coupler shank and striker casting surfaces they engage to make such surfaces effectively resistant against wear.

5 Claims, 8 Drawing Figures

COUPLER CARRIER ARRANGEMENT FOR RAILROAD CARS

This application is a continuation of my now abandoned application Ser. No. 20,438, filed Mar. 14, 1979, which was a continuation of my abandoned application Ser. No. 828,237, filed Aug. 26, 1977.

This invention relates to a coupler carrier arrangement for railroad cars, and more particularly, to the sprung or resiliently supported type coupler carrier for type F couplers that are commonly associated with the familiar open centered striker castings through which the coupler shank extends for anchoring to the car sill.

Couplers of railroad cars are commonly operatively connected to the car in association with the well known striker casting that is fixed to the projecting end of the car center sill at the car end in question. The striker castings involved are normally of open centered configuration defining the usual striking face disposed in a vertical plane, with the coupler shank extending through the casting and bearing a wear plate that rests on the so-called coupler carrier iron supported by the striker casting at the threshold of the striker casting window opening.

This invention is concerned with the resiliently supported type carrier in which the familiar carrier iron is secured on top of the carrier casting that is in turn resiliently supported in the striker casting cage that is in the form of an upwardly facing socket formed in the lower side of the casting at the threshold of the striker casting window opening. The socket in question defines a coupler carrier chamber defining inner and outer side walls disposed crosswise of the center line of draft between which the carrier casting is received. The carrier casting defines oppositely facing side walls, that are in close fitting relation to the indicated coupler carrier chamber side walls, and inwardly indented end portions at either side of the striker casting that are formed for cooperation with vertical movement limiting stops secured to the car center sill on either side of the striker casting. Several coil springs interposed between the carrier casting and the bottom of the striker casting cage in question resiliently support the coupler carrier and the coupler that rests on the carrier iron.

This type of coupler carrier arrangement is commonly employed in AAR standard P type interlocking coupler applications, an illustration of which shown at page S8-19 of the 1974 Edition of Car and Locomotive Cyclopedia published by Simmons-Boardman Publishing Company. Resiliently supported coupler carrier arrangements of this type are commonly employed in cars designed for use in the so-called unit trains.

A major problem that has long plagued railroads has to do with repair requirements of the striker casting cage in which the resiliently supported coupler carrier is mounted, and especially in the case of the high mileage unit train cars.

The fundamental problem involves the fact that when the striker casting cage side walls become worn, the car has to be shopped to repair such walls, either by welding wall liners in place, or by replacing the entire striker casting. While either of these approaches is inordinately expensive, the cage walls in question all too soon wear out after repair, thus resulting in repeated expensive car down time as well as expensive repair procedures, which ordinarily will involve heat treatment of the striker casting after welding where welding is employed.

Analysis of the problem has revealed that a major cause of excessive striker casting cage wear lies in the fact that as trains move over hills, gravity acting on the coupler will tend to bring one or the other of the carrier side walls into rubbing or binding engagement with the striker casting cage side wall opposing same, the specific surfaces involved depending on whether the car is going up or down hill.

Furthermore, the coupler shank is subject to considerable vibration as the car moves along the track, induced due to the car wheels riding over rail joints and the like, resulting in oscillation of the coupler carrier and thus excessive rubbing or galling of the coupler carrier against the cage surfaces involved.

A principal object of the present invention is to provide a coupler carrier arrangement of the sprung type which eliminates the striker casting cage side wall wear problem without requiring modification of the striker casting itself, or the introduction of wet lubricants or movement guides to protect the striker casting surfacing involved.

Another principal object of the invention is to provide a coupler carrier arrangement in which the so-called carrier iron as a separate expendable piece is replaced by a coupler support platform portion at the coupler carrier upper end which is of integral one piece construction with the carrier.

Yet another major object of the invention is to provide a carrier body of one piece integral construction that fits into and operates within the striker casting cage, which body is of dry self lubricating characteristics and instead of causing wear on the striker casting cage surfacing involved, effects a wear resisting resurfacing of the cage side walls in question for eliminating striker casting cage wear as a maintenance problem for the railroads; at the same time, avoiding the need to have the familiar expendable coupler carrier iron at all.

Other important objects of the invention are to provide a coupler carrier arrangement that supports the coupler shank for easy manual shifting of the coupler laterally of the car, and to provide a coupler carrier arrangement that reduces friction of coupler horizontal and vertical movements to the extent that prime mover energy requirements for the train in which the car in question is incorporated are reduced.

Still other objects of the invention are to provide a coupler carrier arrangement that is economical of manufacture, that may be installed at least as readily as conventional coupler carriers, and that is long lived in use.

In accordance with the invention, the familiar multiple piece coupler carrier, including the carrier iron, is replaced by a one piece coupler carrier body that is formed from an ultra high molecular weight polymer of dry self lubricating characteristics that is resiliently mounted in the striker casting cage and defines a horizontally disposed upwardly facing load support surface of special characteristics on which the coupler shank rests, and oppositely facing side walls defining vertically disposed slide surfaces of special characteristics that are formed for close fitting relation with the striker casting cage inner and outer side walls. The coupler carrier load support and side slide surfaces are of integral one piece construction and are characterized by effecting resurfacing of the coupler shank wear plate and striker casting surfaces they engage to make them effectively resistant against wear.

Other objects, uses and advantages will be obvious or become apparent from a consideration of the following detailed description and the application drawings in which like reference numerals indicate like parts throughout the several views.

However, it is to be understood that the specific drawing illustrations provided are supplied primarily to comply with the requirements of the Patent Laws, and that the invention is susceptible of other embodiments that will be obvious to those skilled in the art, and which are intended to be covered by the appended claims.

Figure 1:
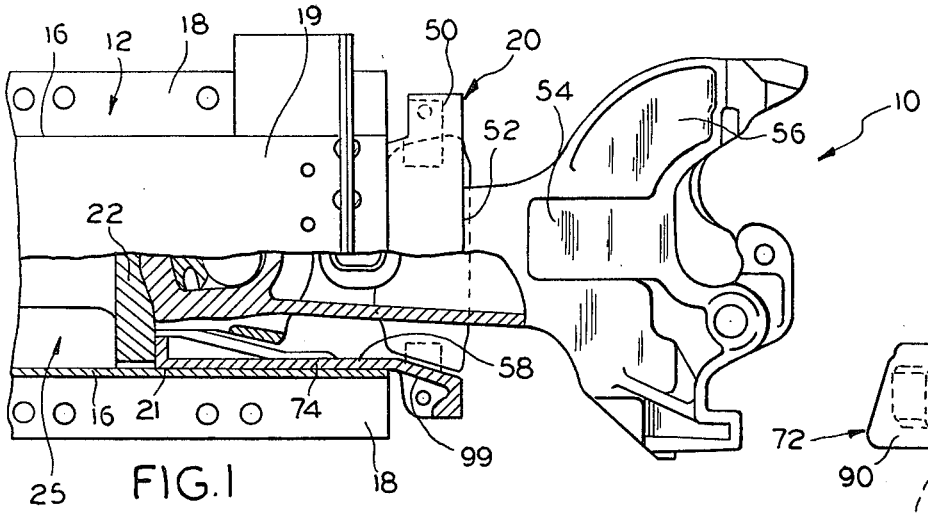
FIG. 1 is a fragmental plan view of the end of a car center sill showing the coupler and striker casting as applied thereto, and partially broken away to show or indicate specific parts of the assembly involved.
Figure 4:
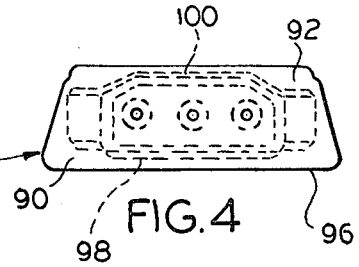
FIG. 4 is a top plan view of the coupler carrier arranged in accordance with the invention, showing the coupler carrier as shaped for wide swing coupler applications.
Figure 2:
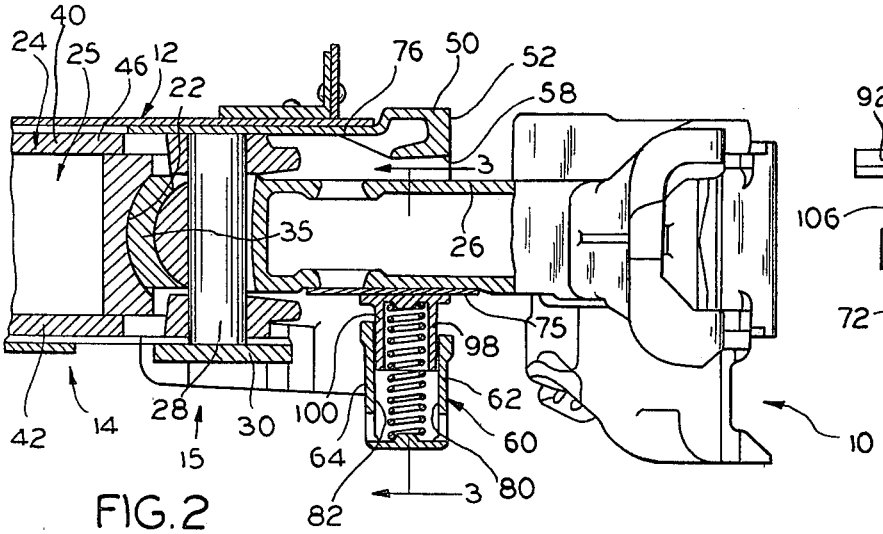
FIG. 2 is a vertical sectional view of the arrangement shown in FIG. 1, with parts shown in elevation.
Figure 5:
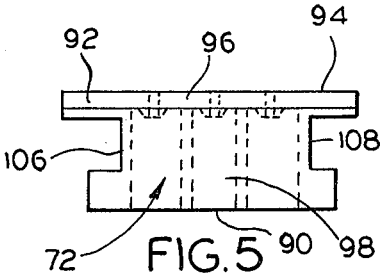
FIG. 5 is a front side elevational view of the coupler carrier shown in FIG. 4.

Reference numeral 10 of FIGS. 1 and 2 generally indicates an AAR type F interlocking coupler applied to conventional center sill 12 that is an integral part of the usual underframe of railroad car body 14 (the latter being largely omitted except for the relevant parts in the area of the operating location of the coupler 10). Car body 14, of course, is wheeled in the usual manner for riding on the usual railroad track rails.

The center sill 12 is of the usual inverted channel shaped type, defining spaced side walls 16 each having laterally directed edge flanges 18. Suitably fixed to the terminal end portion 19 of end sill 12 is conventional striker casting 20 that includes forward draft gear stop lugs 21 (see FIG. 1) against which is seated the usual front follower 22 that is operably associated with conventional draft gear 25 that has its other end seated against the usual rear stop lugs that are not shown. The draft gear 25 (which is shown only diagrammatically as its specifies have nothing to do with the present invention), and its front follower 22 are embraced, as is conventional in car draft gear rigging pockets, by vertical yoke 24 which is connected to the shank 26 of the coupler by connector pin 28 that is supported by support plate 30 that is suitably secured in place across the center sill 12 at the level indicated. As usual, the spherically contoured inner end 35 of the coupler seats against the correspondingly contoured force transmitting recess 37 of the front follower 22.

The yoke 24 comprises the usual upper and lower straps or arms 40 and 42 that are suitably apertured to receive the connector pin 28, and which are integrally connected together at the inner end of the yoke in the usual manner (not shown).

The striker casting 20 comprises the usual vertically disposed striker portion 50 having the planar striking face 52 which is adapted to be engaged by the usual horn 54 of coupler head 56. The striker portion 50 is of generally planar configuration and defines an open center or window 58 through which the coupler shank 26 extends for connection to yoke 24 and thus to center sill 12 through draft gear 25.

The striker portion of casting 20 defines in coplanar relation therewith at the underside of same a cage 60 defined by a forward or outer wall 62 spaced from a rear or inner wall 64, and side walls 66 and 68 (see FIG. 3) which in turn for coupler carrier chamber 70 in which is resiliently mounted coupler carrier 72 that is arranged in accordance with the present invention to support coupler 10.

The striker casting 20 also includes the usual side and back flange structures 74 and 76 that are suitably fixed to center sill in any suitable manner, as by employing riveting, etc. Cage 60 is formed to define the usual drain openings 77.

In practice, the striker casting may follow the general arrangement shown at page S8-19 of the Car and Locomotive Cyclopedia previously referred to.

As is well known in the art, the striker casting cage 60 on the inside of its forward wall 62 defines wear surface 80, while the rear wall 64 defines opposing wear surface 82. The surfaces 80 and 82 extend across the breadth and depth of the chamber 70 and form movement limiting wear surfaces for limiting movement of the coupler carrier longitudinally of the car, as will be apparent from the descriptive material that follows.

In accordance with standard practices, the coupler carrier usually employed is a lower hollow steel casting formed from high tensile cast steel to the upper side of which is suitably fixed the usual carrier iron on which the coupler shank rests. Conventionally, coupler shanks 26 are provided with a wear plate 75, usually welded in place, which physically engages the conventional carrier iron.

Of course, the conventional coupler carrier is resiliently mounted within chamber 70 between the surfaces 80 and 82 in the manner shown at the Car and Locomotive Cyclopedia citation referred to above.

Much of the striker casting damage that has plagued the railroads for a good many years has been in the area of the cage walls 62 and 64. The applicant's consideration of the problem has revealed to him that the major cause of this damage is due to the binding or galling engagement that the conventional coupler carrier has or makes with the walls 62 and 64 in service. Thus, it is well known that the right of way of much railroad trackage involves ascending and descending grades in hilly, rolling, or mountainous terraine. When railroad cars equipped with equipment of the type indicated are moved up or down sloping grades, at each end of the car the coupler is biased under the action of gravity to move inwardly or outwardly of the center sill and striker casting thus bringing the coupler carrier into firm rubbing contact with one of the other of the cavity side walls 62 and 64, and specifically, with one or the other of the movement limiting wear surfaces 80 and 82. The wall involved for any particular time will depend on which end of the car is being considered, and whether the car end in question is at the leading or trailing end of the car, and whether or not the car is going up or down the slope in question. Assuming that the car body 14 has its end 15 at the leading end of the car, and the car is moving up the grade, the coupler carrier for the coupler 10 will then be bearing against the cage wall 64. Assuming that the same car is moving in the same direction down a slope, the coupler carrier will be bearing against the cage wall 62.

Another important aspect of the situation is that as the car moves along the track, the coupler shank is subject to a considerable amount of vibration due to the effect of the car wheels passing over rail joints and the like, and this vibration is passed on to the coupler carrier, with the result that as cars equipped with the equipment indicated are moved along sloping right of ways, the conventional coupler carriers will not only be riding against and bearing on one or the other of the striker casting walls 62 or 64, but also the coupler carriers will be oscillating or vibrating in the plane of the chamber 70 and thereby subjecting the respective cage walls 62 and 64 to extreme conditions of wear (metal upon metal).

This problem requires periodic inspections of striker castings to try to catch cars where striker casting wear at the cage 60 is excessive; where this is the case, the car in question must be shopped for repairing the walls 60 and 62, as by lining them with wear plates, or by replacing the entire striker casting.

Thus, striker casting wear at cage walls 62 and 64 presents a very serious maintenance problem for the railroads which is particularly critical in connection with unit trains where the cars involved are to remain coupled and in service for long periods of time to accomplish the high mileage usage purposes intended for unit trains. Obviously, where one or more cars of the unit train have incurred severe striker casting wear, which usually is found at the cage walls 62 and 64, a break up of the train is required to shop the defective cars in question, with the accompanying inconvenience and loss of pay load time.

In accordance with this invention, the coupler carrier 72 replaces the conventional coupler carrier and carrier iron combination.

The coupler carrier 72 comprises a body 90 of molded one piece construction that includes an upper flanged platform portion 92 defining a substantially planar load support surface 94 on which the coupler shank 26 is to rest. The platform portion 92 is flanged as at 96 about its margin and is proportioned and shaped to fit within the mouth 97 of the striker casting 20 in close fitting relation to the side walls 99 of same. The coupler carrier body 90 below its platform portion 92 is of oblong configuration defining forward wall 98 and rearward wall 100 that respectively oppose the cage surfaces 80 and 82 when the coupler carrier 72 is mounted in the operating position shown in FIGS. 2 and 3.

The body 90 at its ends 102 and 104 below platform portion 92 is notched as indicated at 106 and 108 for cooperation with the conventional stops or retainer plates 55 and 57 that are fixed to the center sill 12 employing suitable rivets 59.

The body 72 is formed to define a plurality of rectilinear recesses each terminating in a spring seat 112 at the inner end of same for receiving the respective load support springs 114 that are interposed between the body 90 and the floor 65 of cage 62. The platform portion 92 of body 90 is formed with the respective drain openings 116 aligned with the respective spring receiving bores or openings 110. Springs 114 each seat on a spring seat portion 117 of the cage bottom wall 65 that are formed with the respective drain openings 119.

Figure 3:
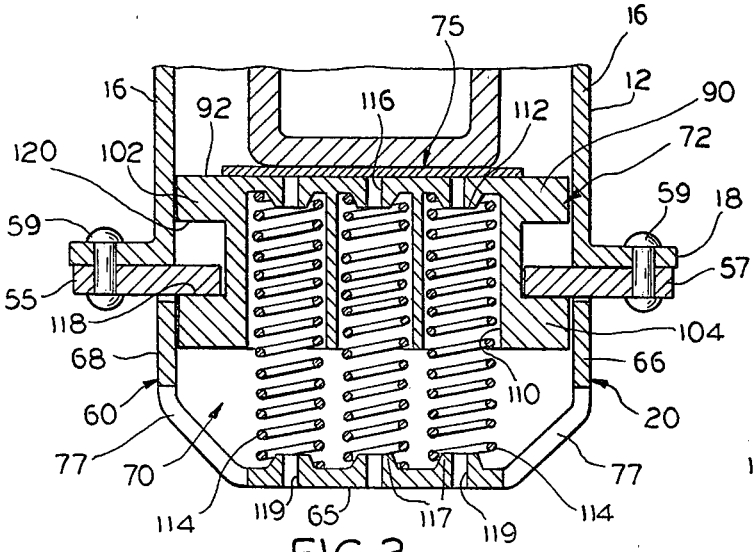
FIG. 3 is a vertical sectional view taken substantially along line 3—3 of FIG. 2, but shown on an enlarged scale.

The notches 106 and 108 are respectively shaped to define opposed stop surfaces 118 and 120 at either end of the body 90 which serve to limit the range of vertical movement permitted by body 90 when mounted in its operating position shown in FIGS. 2 and 3.

In accordance with the invention, body 90 is formed in one piece configuration from ultrahigh molecular weight (UHMW) polyethylene having a molecular weight in the range from about 3 million to about 9 million. In the preferred embodiment, the body 90 is formed from the molecularly oriented UHMW polyethylene marked by Ketrol Enterprises of York, Pa. under the trademark TUFLAR (Grade PL).

The material specified is a high density polymer of dry self lubricating characteristics that is sufficiently compaction resistant to resist any substantial compaction under compressive forces up to its elastic limit, and has a high degree of elastic memory for full return to original shape after being stressed, up to its elastic limit. This material also has a high degree of toughness and long wearing characteristics and is also receptive to fillers in the form of glass, clay, sand, suitable fabrics, and alumina for modifying same to adapt the body 90 for specific conditions.

In accordance with the invention, the body 90 is proportioned below its platform portion such that its walls 98 and 100 will be in closely spaced relation to the respective surfaces 80 and 82 of the cage walls 60 and 64 for making the rubbing contact therewith that has been the source of the wear problem in connection with conventional coupler carrier and carrier iron assemblies.

The polymer material from which the body 90 is formed has a coefficient of sliding or dynamic friction with respect to the surfaces 80 and 82 of about 0.02. However, the contribution to the art provided by this invention involves significantly more than merely providing for a reduced coefficient of friction at the interface between the coupler carrier and walls 62 and 64 of cage 60.

Specifically, the surfaces 98 and 100 of the body 90 effect on the surfaces 80 and 82 a polishing or honing resurfacing action such that, after a period of normal use, the surfaces 80 and 82, instead of being worn away, tend to become resurfaced so as to be effectively resistant against further wear.

What appears to happen is that as the body 90 oscillates or vibrates when in bearing engagement with either of the surfaces 80 or 82, the polymer material of the body 90 tends to fill up the pores and level the irregularities in the metal surfacing forming the respective surfaces 80 and 82, so that the respective surfaces 80 and 82 become partially formed and defined by transferred polymer material from body 90. In service, the resurfacing of the surfaces 80 and 82 is effected where the body 90 engages same during rail transit, with the striker cage surfaces in question taking on a mirror like finish evidencing the protective resurfacing contemplated by this invention.

Any metal worn off the cage side 62 and 64 either drops to the bottom of the cage or becomes embedded in the body 90, and any foreign matter that is caught between the coupler carrier 72 and the striker casting cage walls also drops out of the way or becomes embedded in the body 90, and is thus positioned to avoid the wearing action on the critical cage metal surfaces involved.

The body 90 being formed from the indicated dry self lubricating material eliminates the need for applying separate lubricating materials to the cage 60, which in turn permits the cage 60 to be free of wet type lubricants that might otherwise be employed for this purpose, and which commonly accumulate foreign matter that aggrevates wear problems. The material employed also resists adherence thereto of foreign matter that thus will not accumulate where it could adversely affect the critical cage surfaces 80 and 82.

It has also been found that the surfaces 98 and 100 tend to harden in use thus increasing their ability to resist wear. This is also true of the polymer material transferred to the surfaces 80 and 82 thus further minimizing wear at these important load resisting surfaces. The resulting resurfacing also means that the coefficient of sliding friction at the surfaces 80 and 82 tends to decrease even below the 0.02 figure as the polymer material builds up on the metal surfaces involved.

Figure 8:
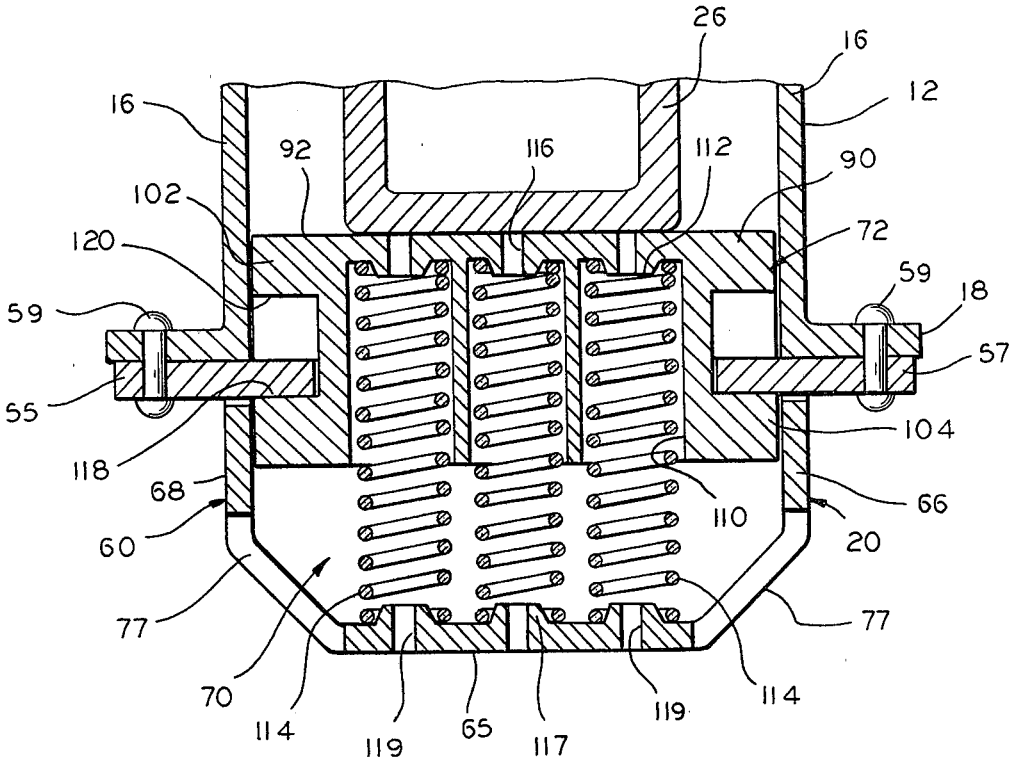
FIG. 8 is the same as FIG. 3 with the exception that the coupler wear plate of FIG. 3 is omitted and the coupler is shown resting directly on the coupler carrier.

The same sort of resurfacing action occurs on the coupler wear plate 75 as the coupler shank 26 moves with respect to the body platform portion 92. As a matter of fact, in practice the wear plate 75 may be eliminated and the coupler shank itself rested directly on the coupler carrier 72 as suggested by FIG. 8.

The result is that striker casting wear at cage 60 is eliminated, as well as at the coupler wear plate 75, with the consequent relieving of the railroads from the troublesome maintenance problems caused by wear occasioned by use of conventional coupler carrier arrangements.

Furthermore the invention now makes it possible for an individual trainman to manually shift couplers equipped with coupler carrier 72, for proper alignment with the coupler of another car to be coupled with the car in question, which is a frequent requirement in the field. It is well known that couplers are rather heavy and difficult to move at best, and strained backs are commonly experienced by trainmen attempting to manually move couplers for this purpose. However, couplers equipped in accordance with this invention may be readily shifted to one side or the other of the center line of draft by the trainmen using one hand, and without requiring any lifting action on the coupler head at all.

Figure 6:
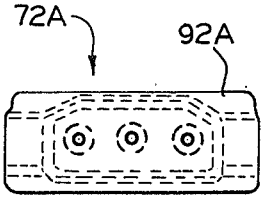
FIG. 6 is a view similar to that of FIG. 4 showing the coupler carrier as arranged for standard side swing couplers.

The coupler carrier 72A of FIG. 6 is the same as the carrier 72 except that its platform portion 92A is proportioned for use with striker casting in which the coupler is to have normal side swing.

Figure 7:
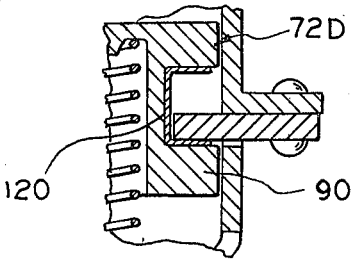
FIG. 7 is a fragmental view similar to that of FIG. 3 illustrating a modified coupler carrier arrangement.

In the form of FIG. 7, the coupler carrier 72B involves the body 90 having its notches 106 and 108 steel lined as at 120 for cooperation with the respective stops or retainer plates 55 and 57. The steel lining 120 may be affixed in place in any suitable manner.

It will therefore be seen that the invention provides a coupler carrier arrangement in which the conventional combination coupler carrier and carrier iron is eliminated in favor of a integral coupler carrier body shaped to define a platform portion on which the coupler shank rests and forward and rearward slide surfaces adapted for rubbing engagement with the critical cage walls 62 and 64 that resurface the former wear surfaces 80 and 82 of same to effectively eliminate wear on the critical striker casting cage walls 62 and 64. A similar wear free resurfacing action occurs where the coupler shank or its wear plate engages the platform surface 94 of the new coupler carrier.

In addition to the advantages described hereinbefore, the coupler carrier arrangement of this application reduces friction in both vertical and horizontal movements of the coupler, and thus contributes to basic energy conservation in terms of train operation, as a train of cars all equipped with the invention will have less energy requirements during transit than a train of cars equipped with standard coupler carrier arrangements.

Another significant benefit provided by the invention is that the formerly required carrier iron no longer needs to be a separate item formed from an expendable material, as is the case with conventional coupler carrier arrangements wherein a material such as 1095 hot rolled steel is employed to form the carrier iron. In accordance with the invention, the platform portion of the new coupler carrier is in one piece integral relation with the remaining portion of the coupler carrier body.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a railroad car wheeled for riding on track rails and having a car underframe including a center sill projecting from the car end and equipped with a coupler striker casting, a draft gear rigging including a draft gear applied within a draft gear pocket between stops spaced longitudinally of the car and within the center sill, and a yoke embracing the draft gear, said strikerr casting including a striker portion having a striking face disposed in a vertical plane and transversely of the car center line of draft and a window opening disposed transversely of and aligned with the car center line of draft, and a coupler having a coupler head disposed outside of the striker casting window and a shank extending through the striker casting window inwardly of the striker casting and operably connected to the yoke for transmitting buff and draft forces to the car, and having swinging movement sidewise of the car and limited movement longitudinally of the car under gravity as the car ascends and descends sloping track grades, and with a striker casting striker portion defining below said window thereof an upwardly opening socket forming the striker casting cage and defining spaced apart inner and outer upright walls extending generally parallel to said vertical plane, and a coupler carrier resiliently supported in said cage for limited vertical movement, on which the coupler shank rests, with said cage walls each defining a coupler carrier movement limiting wear surface for limiting movement of the coupler carrier longitudinally of the car when the coupler moves longitudinally of the car under gravity as the car ascends and descends sloping track grades, the improvement wherein:

said coupler carrier comprises a body formed from polyethylene of dry self lubricating characteristics having a molecular weight in the range of from approximately 3,000,000 to approximately 9,000,000, said body being shaped to define an upper platform portion defining a planar upwardly facing load support surface formed by said polyethylene across the top of same on which the coupler shank rests and which spans the width of the striker casting window, said body further defining below said load support surface a forward side wall forming an outwardly facing slide surface formed by said polyethylene and opposing the cage outer upright wall movement limiting wear surface, and a rear side wall forming an inwardly facing slide surface formed by said polyethylene and opposing the cage inner upright wall movement limiting wear surface, said body outwardly facing slide surface bearing against the cage outer upright wall movement limiting wear surface when gravity induces said coupler longitudinal movement outwardly of the striker casting window, and said body inwardly facing slide surface bearing against the cage inner upright wall movement limiting wear surface when gravity induces said coupler longitudinal movement inwardly of the striker casting window, said body being characterized by having said slide surfaces thereof effecting during transit of the car resurfacing of the cage respective movement limiting wear surfaces they engage under gravity and under vertical vibrations of said body induced by vibration of the coupler shank as the car is moved along a track having a sloping grade, to have a wear free finish over the portions of same that are respectively engaged by the respective body slide surfaces, with said slide surfaces and said finishes tending to harden in use, whereby said cage movement limiting surfaces become effectively resistant to wear under said vertical vibrations of said body.

2. The improvement set forth in claim 1 wherein:

said body including said slide surfaces is formed entirely of said polyethylene.

3. The improvement set forth in claim 1 wherein:

the coupler shank directly engages said body load support surface.

4. In a railroad car wheeled for riding on track rails and having a car underframe including a center sill projecting from the car end and equipped with a coupler striker casting, a draft gear rigging including a draft gear applied within a draft gear pocket between stops spaced longitudinally of the car and within the center sill, and a yoke embracing the draft gear, said striker casting including a striker portion having a striking face disposed in a vertical plane and transversely of the car center line of draft and a window opening disposed transversely of and aligned with the car center line of draft, and a coupler having a coupler head disposed outside of the striker casting window and a shank extending through the striker casting window inwardly of the striker casting and operably connected to the yoke for transmitting buff and draft forces to the car, and having swinging movement sidewise of the car and limited movement longitudinally of the car under gravity as the car ascends and descends sloping track grades, and with the striker casting striker portion defining below said window thereof an upwardly opening socket forming a stroker casting cage and defining spaced apart inner and outer upright walls extending generally parallel to said vertical plane, and a coupler carrier resiliently supported in said cage for limited vertical movement, on which the coupler shank rests, with said cage walls each defining a coupler carrier movement limiting wear surface for limiting movement of the coupler carrier longitudinally of the car when the coupler moves longitudinally of the car when the coupler moves longitudinally of the car under gravity as the car ascends and descends sloping track grades, the method of making said striker casting cage movement limiting wear surfaces effectively resistant against wear due to vertical vibrations of the coupler carrier when engaged thereby, said method comprising:

using as the coupler carrier a body formed from polyethylene of dry self lubricating characteristics having a molecular weight in the range of from approximately 3,000,000 to approximately 9,000,000, and shaped to closely fit within the cage and define slide surfaces respectively opposing the cage respective movement limiting wear surfaces for engagement therewith when the coupler moves longitudinally of the car under gravity as the car ascends and descends track grades, and when the car is in transit, causing said body slide surfaces to resurface said cage movement limiting wear surfaces, when the respective cage movement limiting wear surfaces are engaged by the respective body slide surfaces, under vertical vibrations induced in said body relative to the cage when the car is in transit over sloping track grades, for providing said surfaces with a wear free finish.

5. The method set forth in claim 4 including:

permitting said slide surfaces and said finishes to harden with continued use of said body as the coupler carrier.

* * * * *